US005663712A

United States Patent [19]

Kamp

[11] Patent Number: 5,663,712

[45] Date of Patent: Sep. 2, 1997

[54] ELECTRICAL CONTACT POSITION INDICATOR ASSEMBLY

[75] Inventor: Eugene L. Kamp, Fulton, Mo.

[73] Assignee: Hubbell Incorporated, Orange, Conn.

[21] Appl. No.: 369,536

[22] Filed: Jan. 5, 1995

Related U.S. Application Data

[63] Continuation-in-part of Ser. No. 366,576, Dec. 30, 1994, abandoned.

[51] Int. Cl.[6] ..... G08B 21/00

[52] U.S. Cl. ..... 340/644; 340/635; 340/643; 340/815.63; 361/72; 361/115; 335/17; 335/28

[58] Field of Search ..... 340/644, 635, 340/815.63, 815.65, 643; 362/35, 66, 174; 116/204; 361/72, 115; 335/17, 20, 27, 28, 32, 34

[56] References Cited

U.S. PATENT DOCUMENTS

| | | | |
|---|---|---|---|
| 2,585,974 | 2/1952 | Taylor et al. | 340/815.63 |
| 2,738,394 | 3/1956 | Matthews | 361/115 |
| 2,866,965 | 12/1958 | Houdek, Jr et al. | 340/815.63 |
| 3,852,556 | 12/1974 | Kane et al. | 335/17 |
| 3,872,469 | 3/1975 | Loughran, Jr. | 340/815.63 |
| 4,132,986 | 1/1979 | Hart et al. | 340/815.63 |
| 4,351,994 | 9/1982 | Evans et al. | 200/153.5 C |
| 5,015,810 | 5/1991 | Eppinger et al. | 200/147 R |
| 5,103,364 | 4/1992 | Kamp | 361/72 |
| 5,497,096 | 3/1996 | Banting | 340/815.63 |

OTHER PUBLICATIONS

Mc Graw—Edison Bulletin—"Reclosers Types VSA and VSML; Three–Phase; Electronically Controlled—" Nov. 1978 p. 1.

Mc Graw—Edison Bulletin—"Reclosers Type VSO; Three–Phase; Electronically Controlled"— Sep. 1980 pp. 7 and 15.

Mc Graw—Edison Bulletin—"Reclosers Type ME; Three–Phase; Electronically Controlled"—Dec. 1978 p. 7.

Mc Graw—Edison Bulletin—"Reclosers Types RV, RX, VW, VWV, W, WV; Three–Phase", 1981 p. 7.

ESR—"Simplified Construction"—Prior to May 18, 1994, p. 2.

Joslyn JVR Vacuum Recloser—May 1994, pp. 1 and 3.

S & C Scada Mate Switching System, prior to Jan. 5, 1994, p. 4.

NEBB—"Service and Maintenance of the Switchgear" May 1994, pp. 28 and 28a.

Cooper Power Systums Brochure—"Kyle Type VXE Electronically Controlled Vacuum Single–Phase Reclosers" Nov. 1992.

*Primary Examiner*—Brent A. Swarthout
*Assistant Examiner*—Vam T. Trieu
*Attorney, Agent, or Firm*—Jerry M. Presson; David L. Tarnoff

[57] ABSTRACT

An electrical contact position indicator assembly is operatively coupled to an electrical device, such as a recloser, for indicating the relative position of the contacts of the electrical device, i.e., opened or closed, at any given time during operation of the electrical device. The position indicator assembly includes a movable indicator having first indicia to indicate that the contacts are opened, and second indicia to indicate that the contacts are closed. Each of the first and second indicia of the indicator lies in more than one plane. Preferably, each of the first and second indicia of the indicator lies on a three-dimensional, curvilinear or spherical surface. In the preferred embodiment, the indicator includes a mechanical linkage to the contact opening and closing assembly.

20 Claims, 14 Drawing Sheets

ELECTRICAL CONTACT POSITION INDICATOR ASSEMBLY

RELATED APPLICATION

This application is a continuation-in-part of U.S. patent application Ser. No. 08/366,576 (31494), filed on Dec. 30, 1994 in the name of Eugene L. Kamp and entitled Electrical Contact Position Indicator Assembly which was abandoned due to incomplete application.

FIELD OF THE INVENTION

The present invention generally relates to an electrical contact position indicator assembly for switched electrical devices to indicate opened and closed positions of the electrical contacts. More specifically, the present invention relates to an indicator assembly for electrical devices with a fault interrupter mechanism or circuit, such as an electrical recloser, to indicate opened and closed positions of the electrical contacts.

BACKGROUND OF THE INVENTION

Electrical devices often require servicing by a lineman to maintain or repair the electrical devices. In the case of switched electrical devices, an indicator is sometimes provided to indicate to the lineman the condition or position of the contacts, i.e., opened or closed, at any given time. Such indicators are often used in electrical devices with current interrupters such as reclosers.

In a conventional recloser, an internal interrupter assembly is provided within a tank, and an external operating mechanism is mounted to the exterior of the tank to permit a lineman to open and close the contacts of the recloser. Specifically, the external operating mechanism includes an operating arm that is movable between upper and lower positions to manually initiate closing and opening of the contacts of the interrupter within the tank so that a lineman can interrupt current flow through the reclosers when carrying out maintenance on the distribution system. This operating arm can essentially act as a contact position indicator for indicating to the lineman the position or condition of the contacts. However, the operating arm is not always reliable and can be difficult for a lineman to see from a variety of angles when determining the condition of the contacts.

This problem has led to the addition of a separate indicator coupled to the exterior of the recloser tank, which is movable between two positions to indicate the condition of the contacts of the recloser. However, like the operating arm, these indicators are often difficult to see, except if the lineman climbs up the utility pole. Specifically, these prior art indicators are typically flat, planar members with indicia thereon, which are difficult to see unless the lineman is directly in front of the indicator.

Reclosers can be either hydraulically or electronically controlled. Reclosers typically employ a switch box having a lever switch or the like for permitting manually actuated opening and closing of the interrupter contacts. In many of these devices, a separate indicator, as mentioned above, is provided which is movable between two positions to indicate the condition of the interrupter at any given time during operation of the recloser. Closing energy is typically supplied by a relatively large closing solenoid which simultaneously charges one or more opening springs in preparation for a tripping operation. During operation of the known devices, fault currents are sensed by a trip solenoid which initiates tripping of the contacts by releasing the opening springs. Thereafter, a hydraulic or an electronic control mechanism carries out time-delay operations and regulates the number of operating cycles to lock out of the recloser. The operating arm and/or the separate indicator indicates to the lineman the condition of the contacts at any given time during operation of the recloser.

Examples of a single-phase recloser incorporating this construction are the Types D and DV hydraulically controlled, single-phase reclosers marked by McGraw-Edison, while examples of a three-phase recloser of this construction are known from the Types RV, VW and WV reclosers marketed by McGraw-Edison. Examples of reclosers with an electronic control assembly are the Types RVE, VWE, WVE and VSO three-phase reclosers marked by McGraw-Edison. However, all of the contact position indicators of these relcosers are difficult to view from a wide variety of angles.

In view of the foregoing, it is apparent that there exists a need for an electrical contact indicator which will overcome the above problems of the prior art electrical devices. This invention addresses this need in the art along with other needs, which will become apparent to those skilled in the art once given this disclosure.

SUMMARY OF THE INVENTION

One object of the present invention is to provide an electrical contact position indicator assembly for an electrical device, which is easily seen from many different view points.

Another object of the present invention is to provide an electrical contact position indicator assembly, which can accommodate and absorb over travel forces and dimensional variations of the switch mechanism for opening and closing the contacts of the electrical devices.

Another object of the present invention is to provide an electrical contact position indicator assembly, which uses a static face seal instead of a moving seal, to minimize the force required to operate the indictor.

Another object of the present invention is to provide an electrical contact position indicator assembly, which is protected from harmful effects of direct sunlight.

Yet another object of the present invention is to provide an electrical contact position indicator assembly, which is relatively inexpensive to manufacture and to install.

Still another object of the present invention is to provide an electrical contact position indicator assembly, which can be assembled substantially externally of the electrical device.

The foregoing objects are basically attained by providing an electrical contact position indicator assembly comprising a housing adapted to be mounted to an electrical device; a three-dimensional indicator movably mounted to the housing between a first position and a second position, the indicator including a first three-dimensional area with first indicia thereon being visible in the first position and concealed in the second position, and a second three-dimensional area with second indicia thereon being visible in the second position and concealed in the first position; and an operating mechanism for moving the indicator between the first and second positions. The first and second areas of the indicator each have their surface being arranged, when in said first and second positions, respectively, to be visible substantially from in front, from below and from both sides of the indicator.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

Referring now to the drawings which form part of this original disclosure.

DETAILED DESCRIPTION OF THE PREFERRED EMBODIMENT

Referring initially to FIGS. 1–4, an electrical contact position indicator assembly 10 is illustrated in accordance with the present invention for indicating the status, i.e., opened or closed position, of the contacts of an electrical device. In the preferred embodiment illustrated in the figures, contact position indicator assembly 10 is operatively installed on a recloser 12. Of course, it will become apparent to those skilled in the art from this disclosure that indicator assembly 10 can be installed on any electrical device with certain modifications thereto to indicate the flow of current within the electrical device, i.e., an opened position when no current is present, and a closed position when current is present.

In the case of electrical devices with an interrupter assembly or a switch mechanism such as recloser 12 illustrated in FIGS. 5 and 6, the contact position indicator assembly 10 is operatively coupled to the interrupter assembly or switch mechanism 33 for indicating when the main contacts of recloser 12 are either opened or closed, as discussed below in more detail. Indicator assembly 10 is mounted to the exterior of recloser 12 and coupled to main latching plate 62 in such a manner so that very little force is needed to operate indicator assembly 10.

Figure 5:
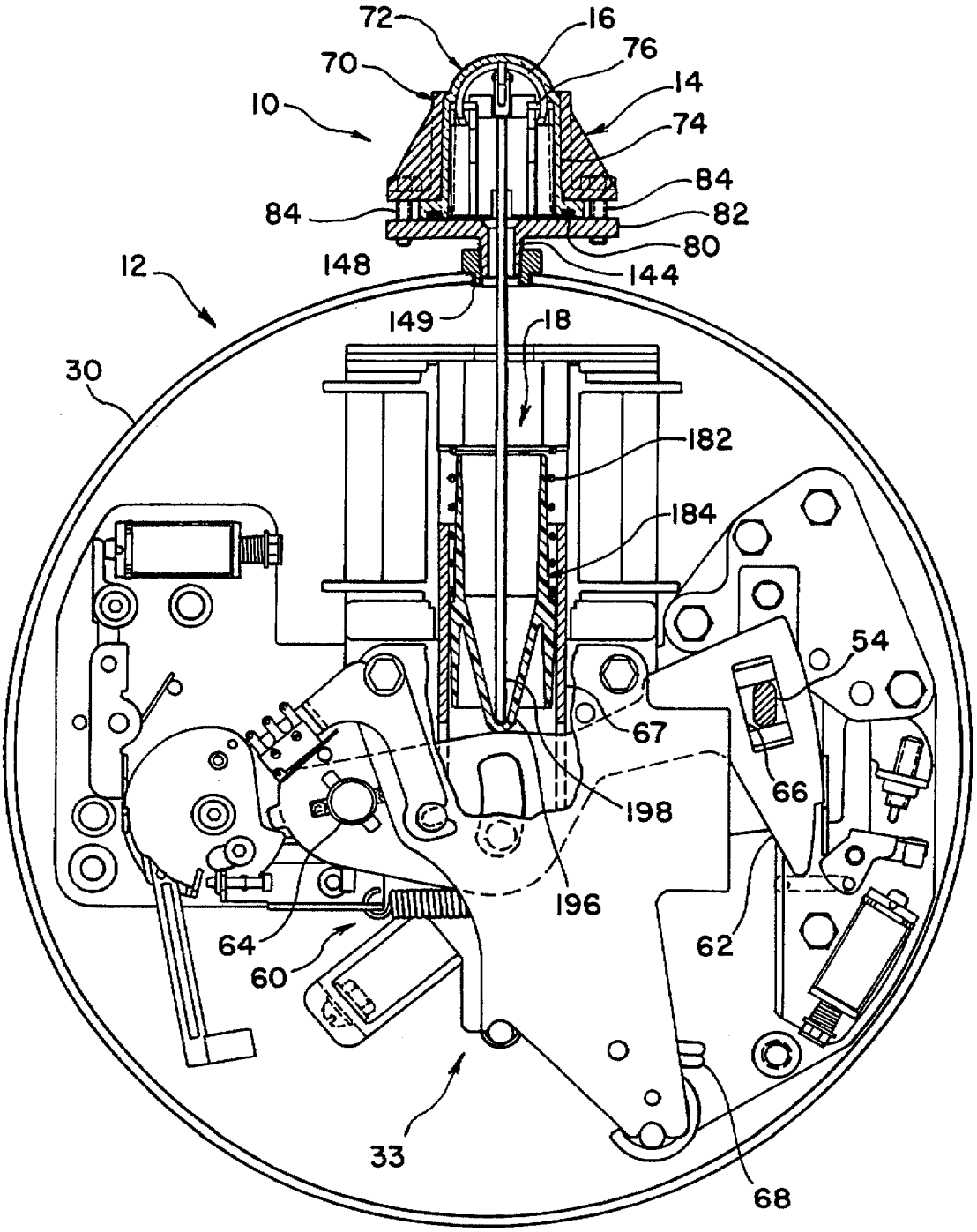
FIG. 5 is a transverse cross-sectional view of the electrical contact position indicator assembly coupled to the recloser and illustrating the closed contact position.
Figure 6:
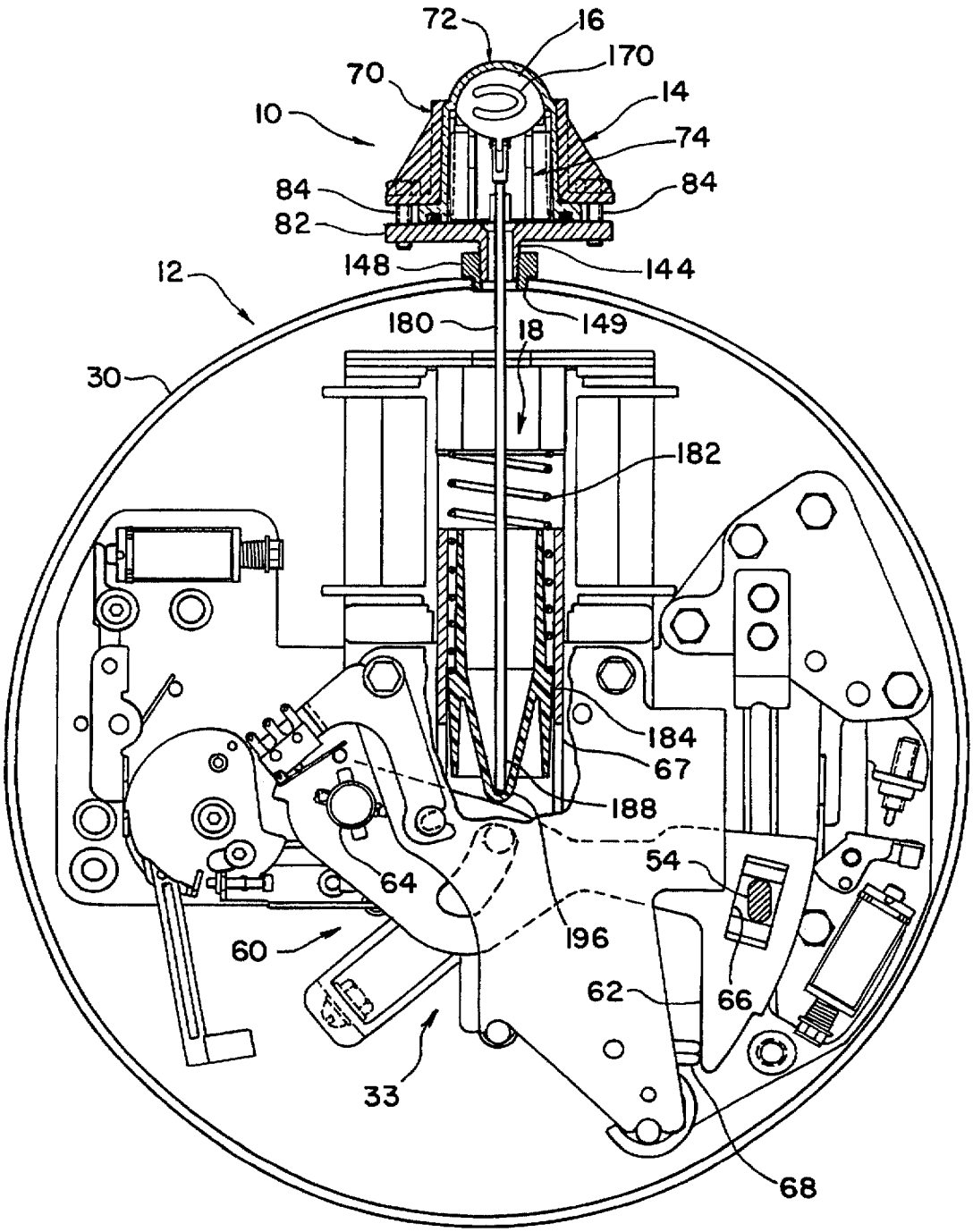
FIG. 6 is a transverse cross-sectional view of the electrical contact position indicator assembly coupled to the recloser, similar to FIG. 5, but illustrating the opened contact position.

Referring to FIGS. 3–6, indicator assembly 10 basically includes an indicator housing 14 removably fastened to the exterior of recloser 12, an indicator 16 located with housing 14 for indicating opened and closed positions of the main contacts of recloser 12, and an operating mechanism 18 operatively coupled between the interrupter of recloser 12 and indicator 16 for moving indicator 16 between a first position indicating the closed contact position of recloser 12 (FIG. 5) and a second position indicating an opened contact position of recloser 12 (FIG. 6). Indicator 16 of indicator assembly 10 is designed so that it can be seen from a wide variety of angles, including from below, either the left or right sides of the recloser 12 and across the road, when indicator assembly 10 is installed on recloser 12. In other words, indicator assembly 10 is designed to provide a wide field of view so that the linemen can readily see if the main contacts of recloser 12 are in either the opened contact position or the closed contact position as explained below.

Indicator assembly 10 is designed to be basically assembled externally of recloser 12 with its parts nested together and interlocked so that indicator assembly 10 can be easily retrofitted to existing electrical devices or reclosers. Of course, in an alternative version, indicator assembly could be more integrally formed with the recloser or electrical device. For example, part of indicator housing 14 can be an integral part of the recloser or electrical device or could have a portion formed therewith.

By way of example, indicator assembly 10 will be described as installed on an electronic recloser such as the one disclosed in U.S. Pat. No. 5,103,364 to Kamp, which is hereby incorporated herein by reference. Since the specific recloser or electrical device utilized in conjunction with indicator assembly 10 is not critical to the present invention, recloser 12 will only be broadly discussed herein to enable one skilled in the art to understand the present invention.

Figure 1:
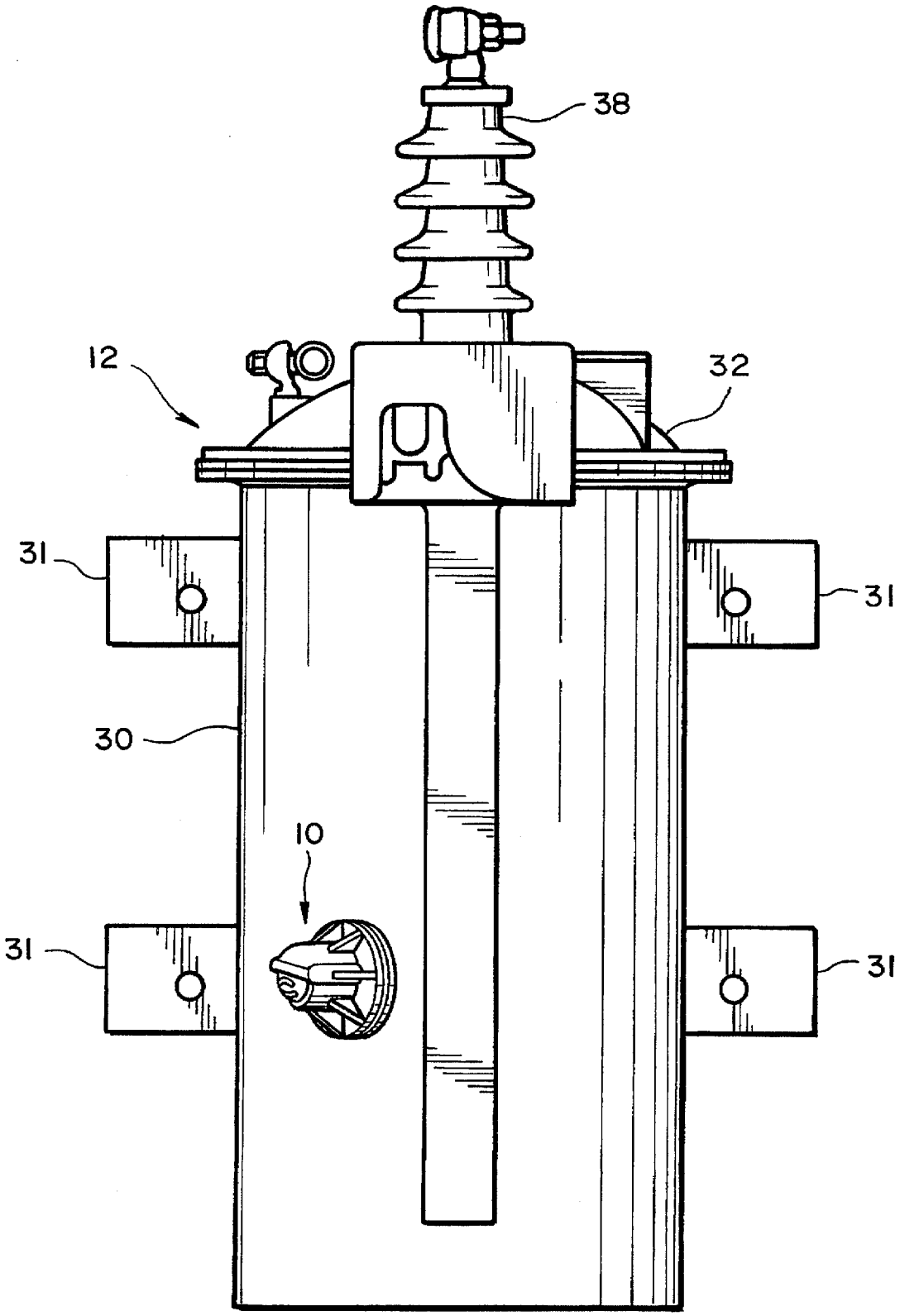
FIG. 1 is a front elevational view of a recloser having an electrical contact position indicator assembly in accordance with the present invention installed thereto and indicating a closed contact position.
Figure 2:
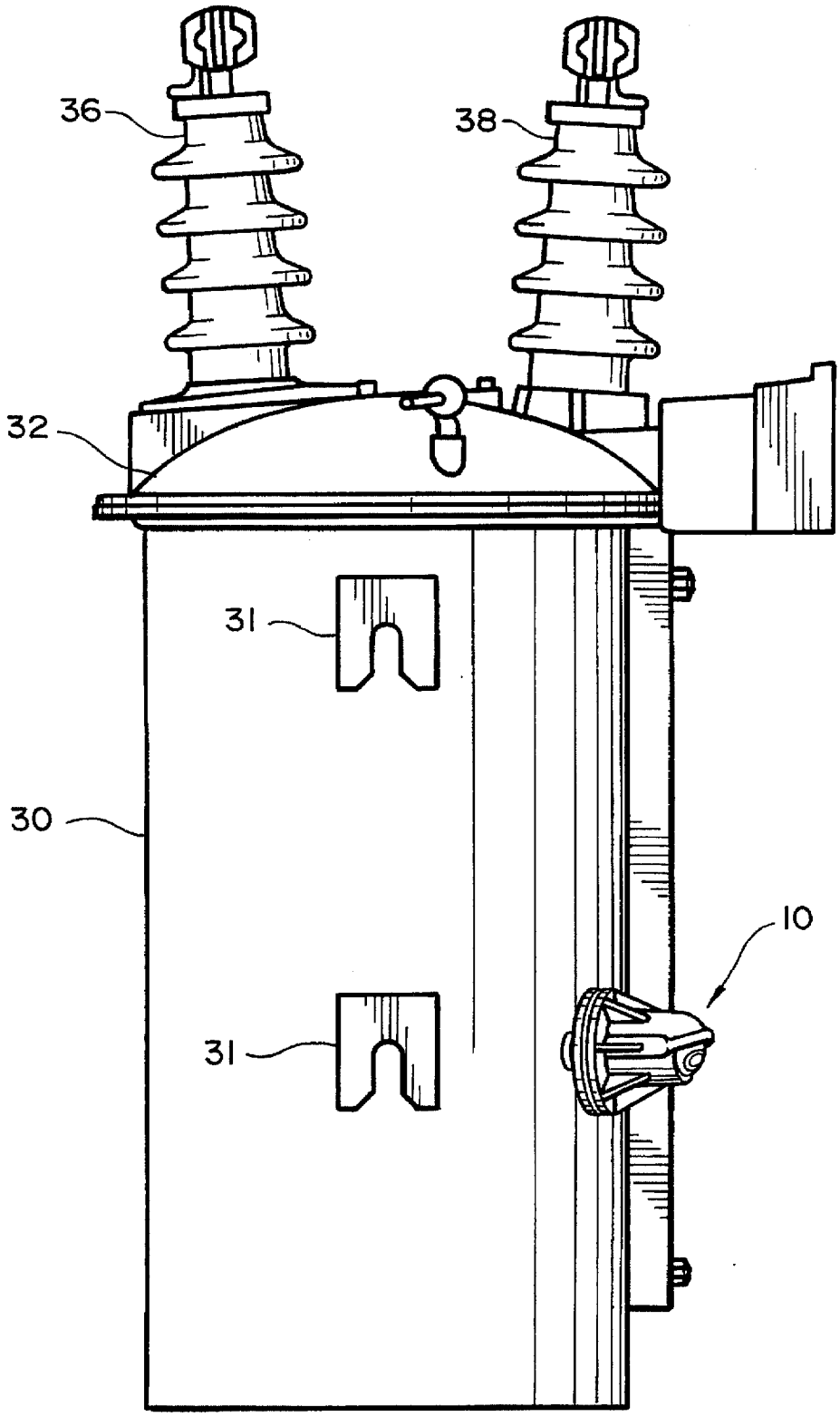
FIG. 2 is a side elevational view of the recloser with the electrical contact position indicator assembly of FIG. 1 in accordance with the present invention.
Figure 3:
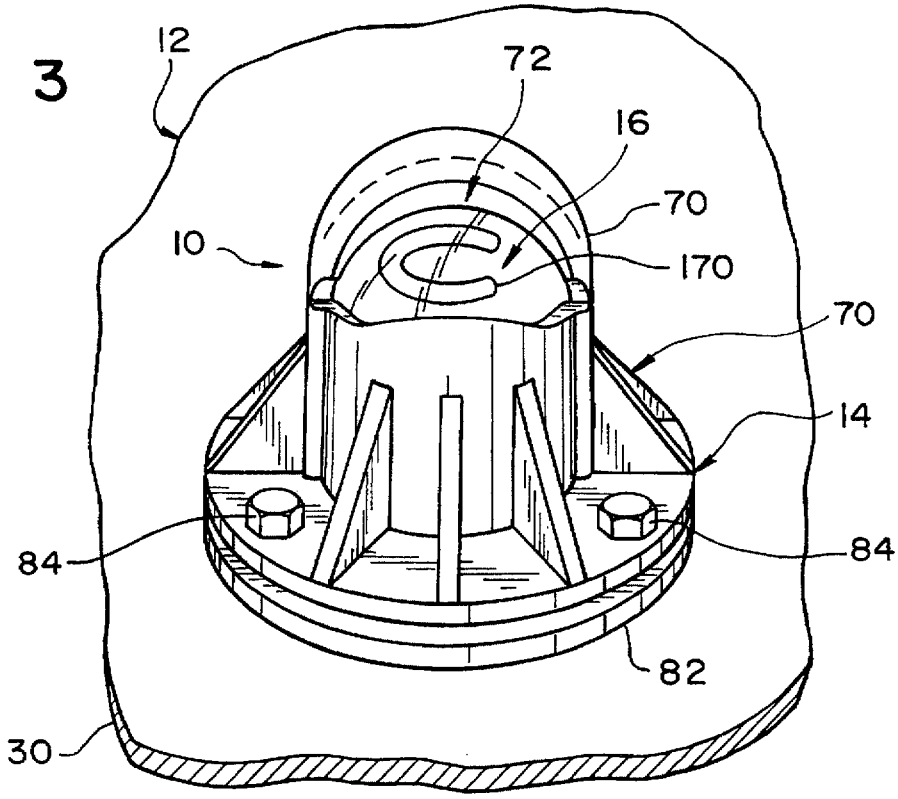
FIG. 3 is an enlarged, partial bottom perspective view of the electrical contact position indicator assembly coupled to the recloser with the position indicator indicating the closed contact position.
Figure 4:
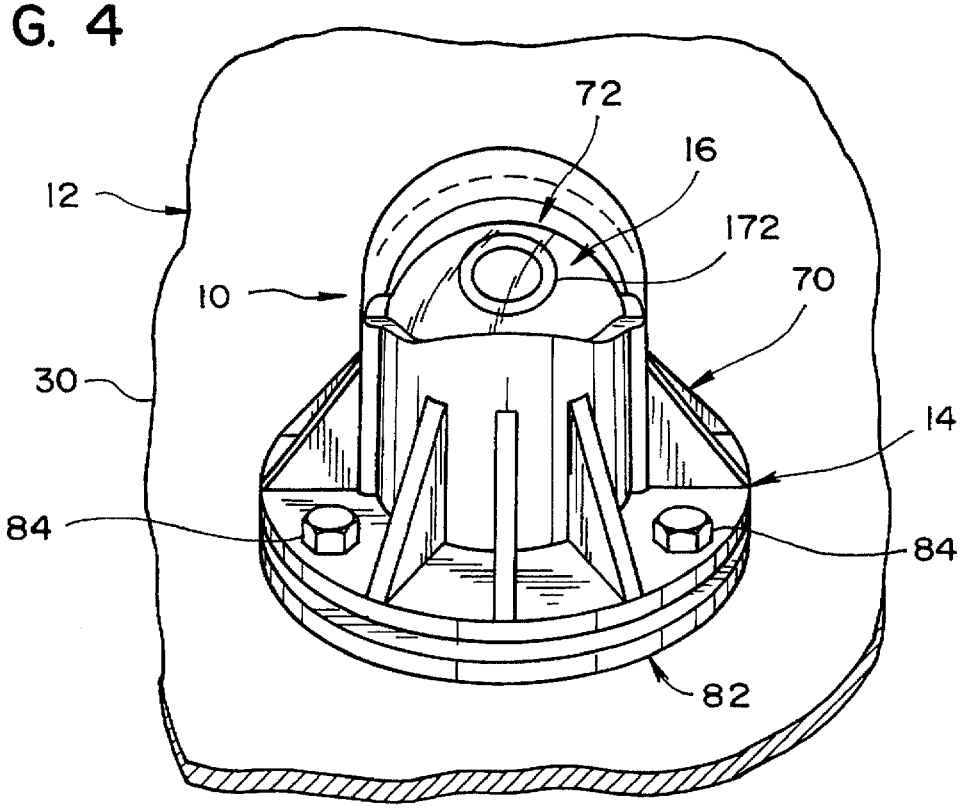
FIG. 4 is an enlarged, partial bottom perspective view of the electrical contact position indicator assembly coupled to the recloser with the position indicator indicating the opened contact position.

As seen in FIGS. 1 and 2, recloser 12 has a housing or tank 30 with a set of mounting brackets 31 thereon for mounting recloser 12 to a utility pole or the like. A cover 32 is removably attached to tank 30 in a conventional sealing arrangement to permit access to an interrupter assembly 33 disposed within the interior space of tank 30 as seen in FIGS. 5–9. Tank 30 together with cover 32 define a sealed interior space which is preferably filled with an insulating gas such as $SF_6$ gas or the like, and which houses interrupter assembly 33 as seen in FIGS. 5–9 and as discussed below.

Recloser 12 further includes a pair of insulated bushings 36 and 38 extend outwardly from tank 30 for connecting interrupter assembly 33 to a source line and a load line, respectively. The transmission of electrical energy enters recloser 12 via source bushing 36 and exits recloser 12 via load bushing 38. Interrupter assembly 33 includes an interrupter 40 coupled within tank 30 between source bushing 36 and load bushing 38 for selectively interrupting the flow of current between bushings 36 and 38 and a main latching assembly 60.

Figure 7:
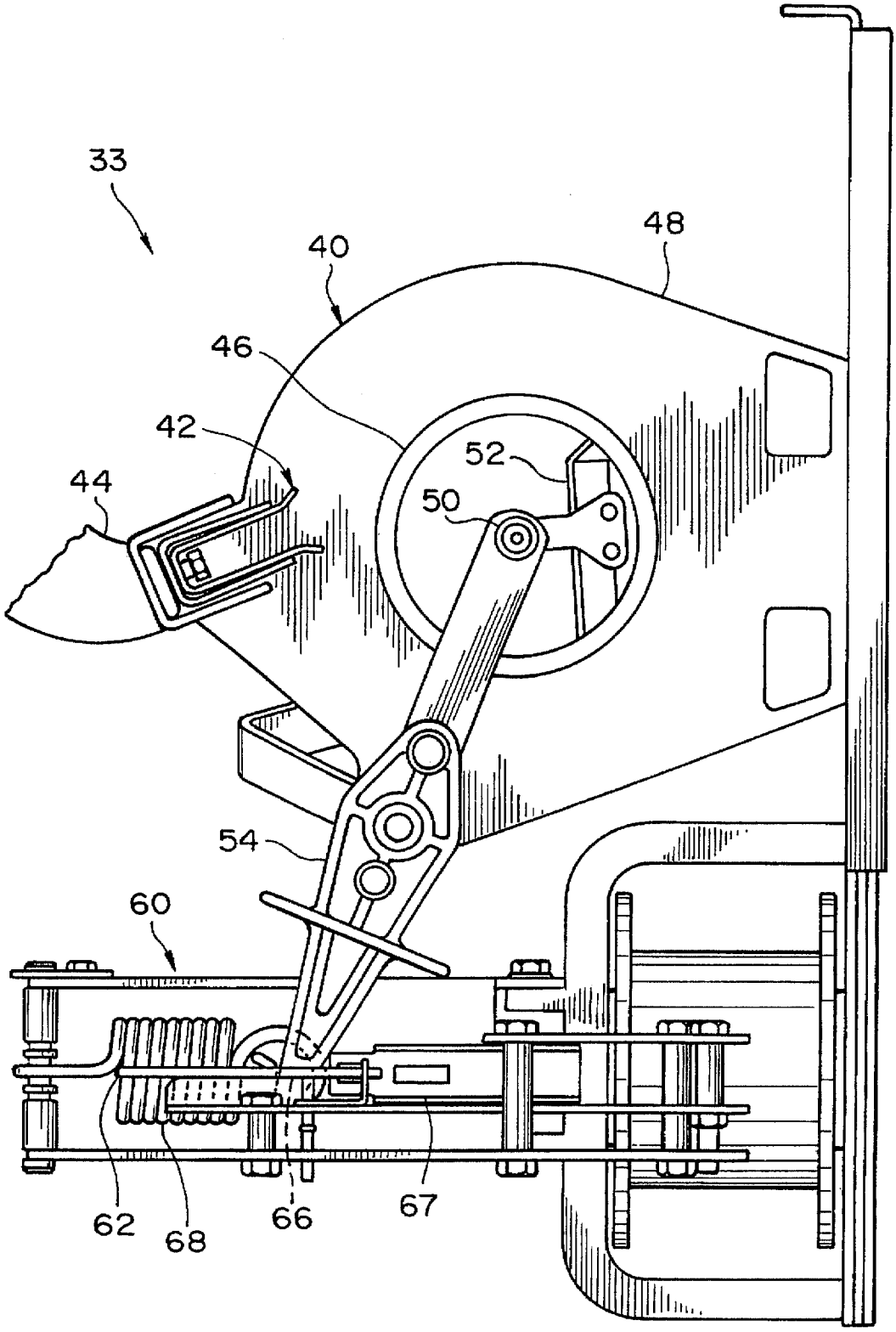
FIG. 7 is an elevational view of the interrupter and the main latching assembly for the recloser of FIG. 1, with the interrupter in the opened contact position.
Figure 8:
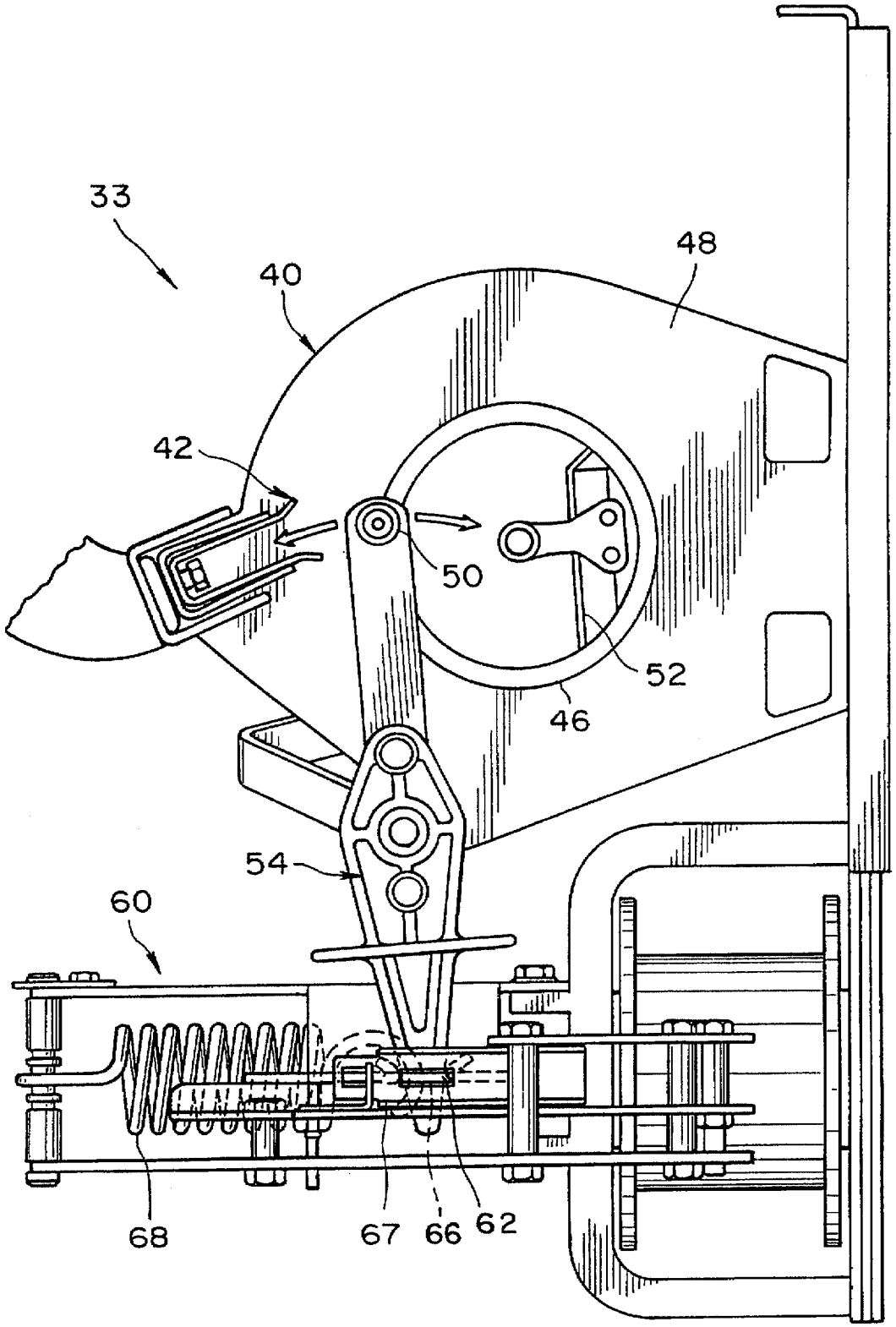
FIG. 8 is an elevational view of the interrupter and the main latching assembly similar to FIG. 7, with the interrupter shown in an intermediate position between a fully opened contact position and a closed contact position.
Figure 9:
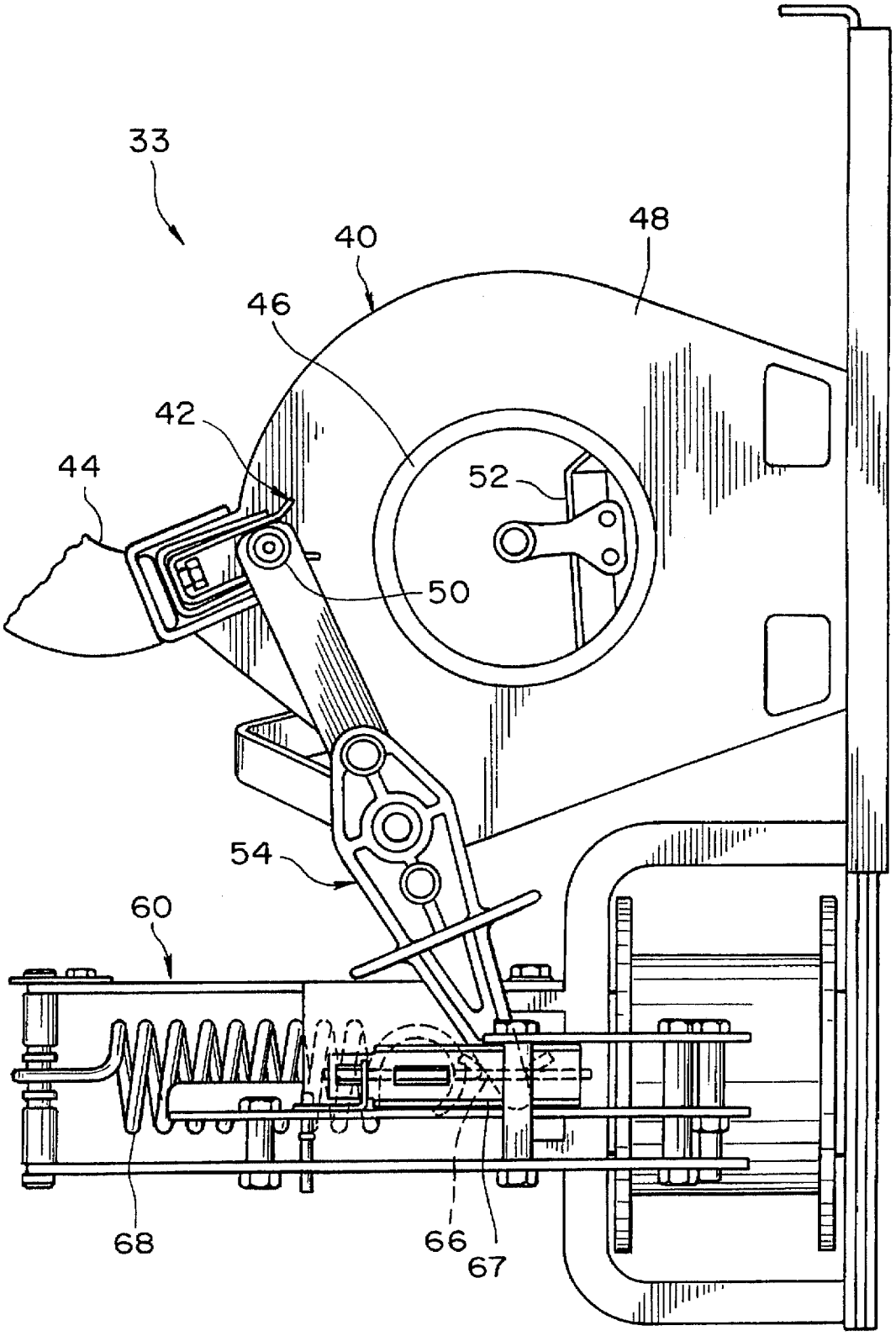
FIG. 9 is an elevational view of the interrupter and the main latching assembly for the recloser of FIG. 1, with the interrupter in the closed contact position.
Figure 10:
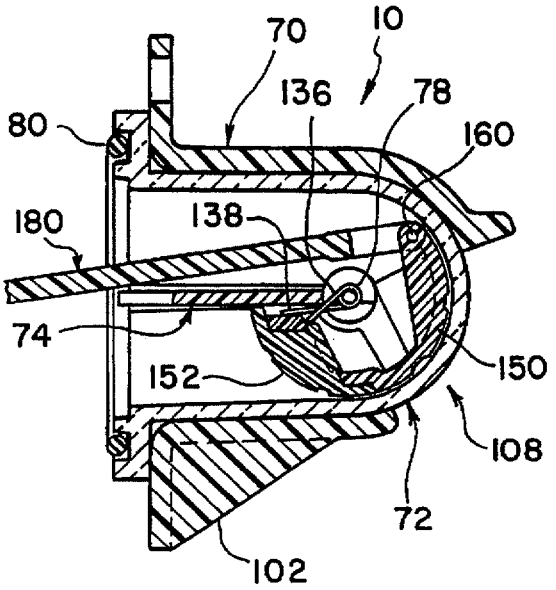
FIG. 10 is a partial side longitudinal, cross-sectional view of the electrical contact position indicator assembly of FIGS. 1–6 in the closed contact position.
Figure 11:
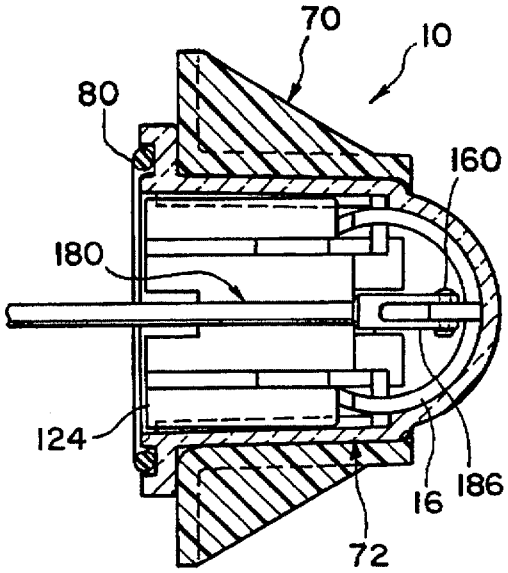
FIG. 11 is a partial top longitudinal, cross-sectional view of the electrical contact position indicator assembly of FIG. 10 in the closed contact position.
Figure 12:
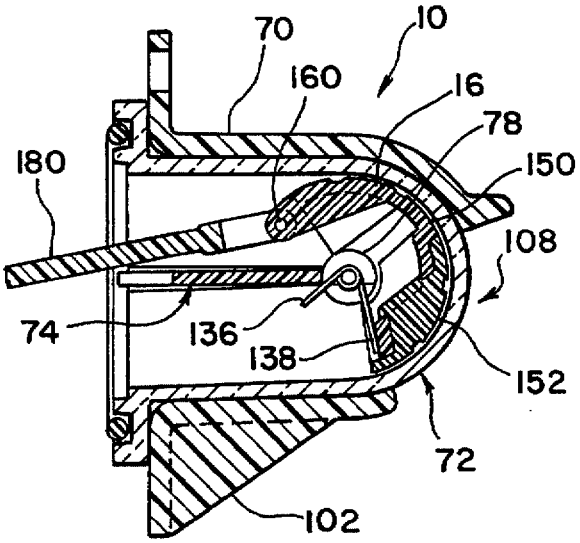
FIG. 12 is a partial side longitudinal, cross-sectional view of the electrical contact position indicator assembly similar to FIG. 10, but illustrating the opened contact position.
Figure 13:
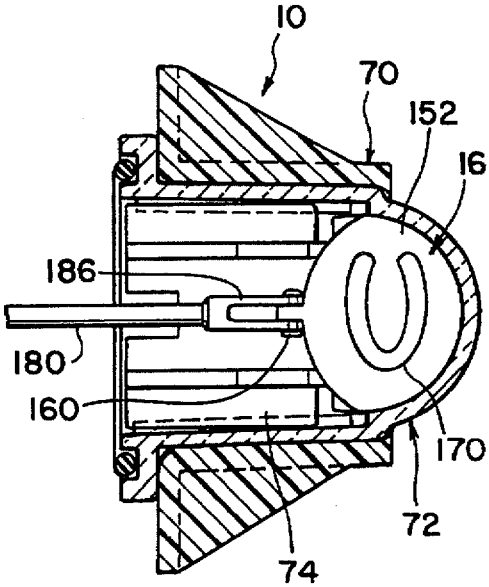
FIG. 13 is a partial top longitudinal cross-sectional view of the electrical contact position indicator assembly of FIG. 12 in the opened contact position.
Figure 14:
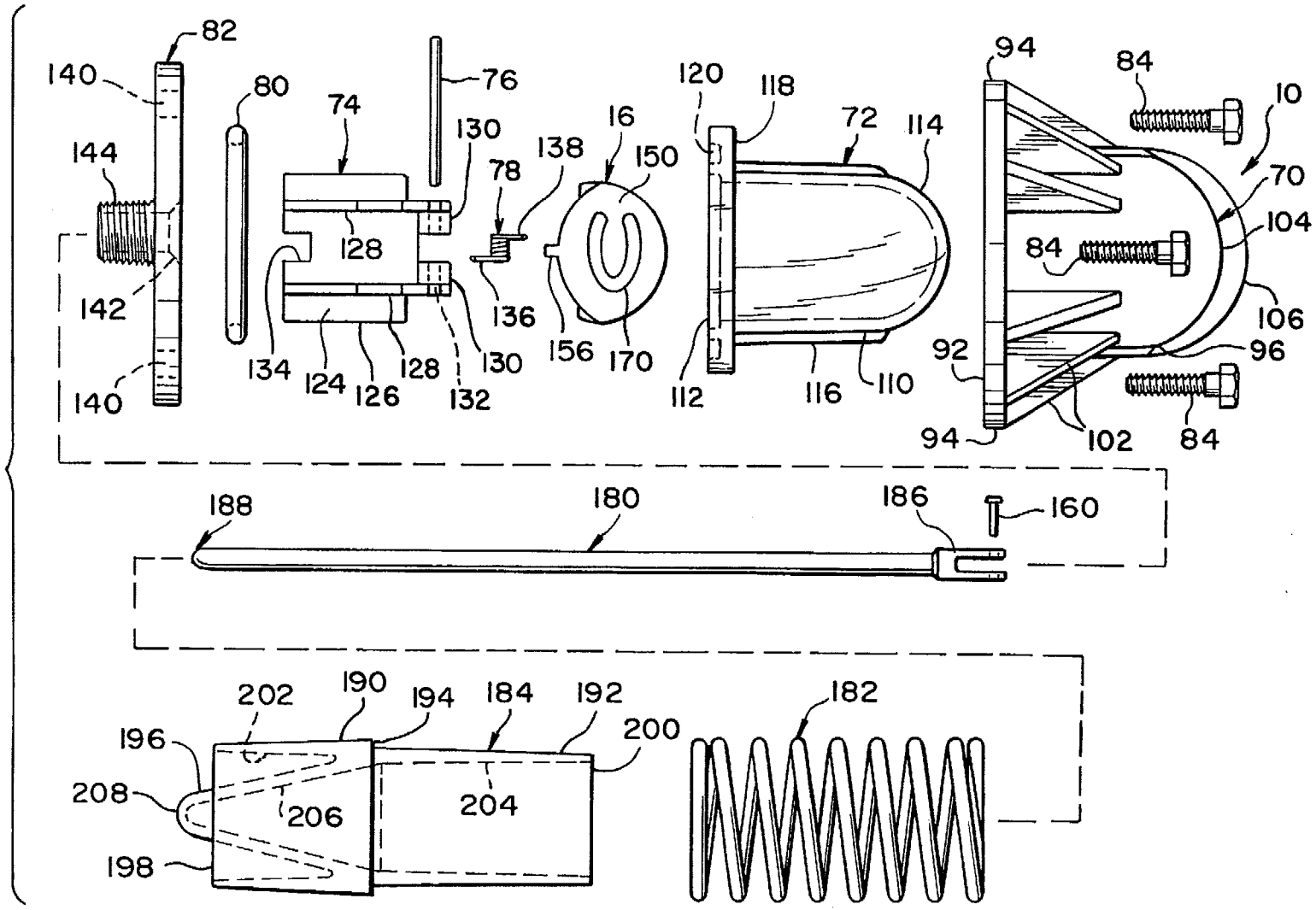
FIG. 14 is an exploded, top plan view of the electrical contact position indicator assembly of FIGS. 1–6 and 11–13 in accordance with the present invention.
Figure 15:
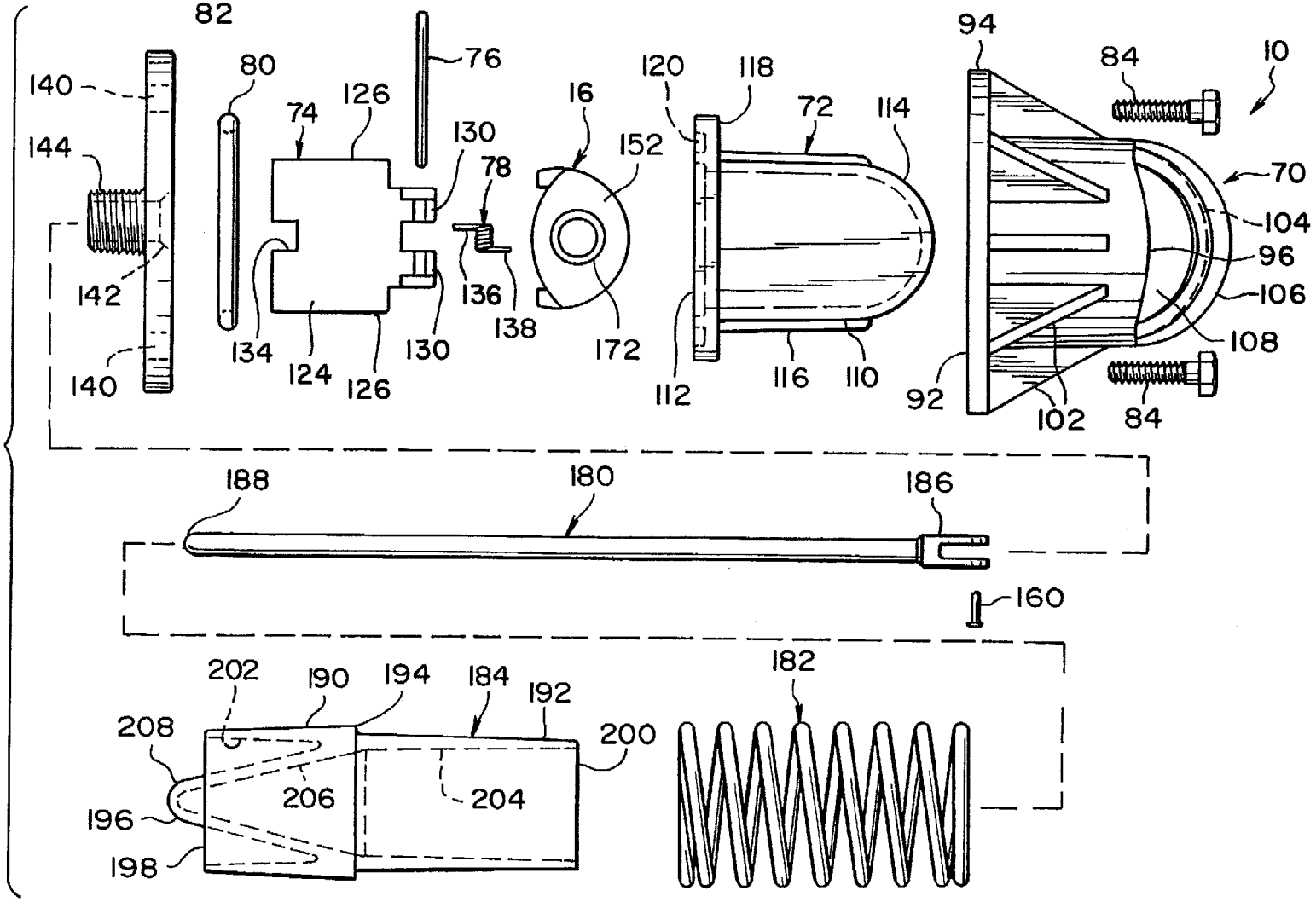
FIG. 15 is an exploded, bottom plan view of the electrical contact position indicator assembly of FIGS. 1–6 and 11–14.
Figure 16:
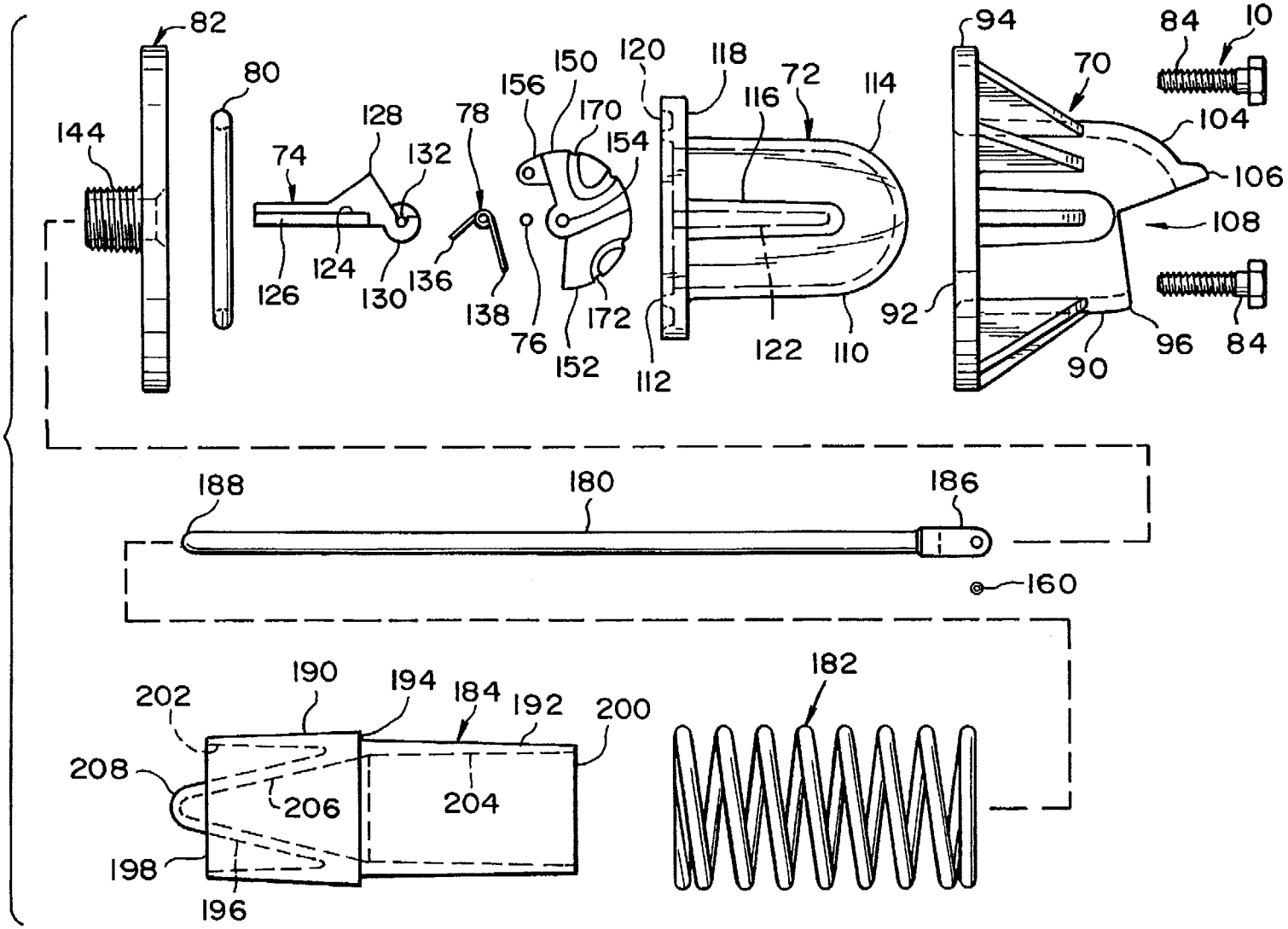
FIG. 16 is an exploded, side elevational view of the electrical contact position indicator assembly of FIGS. 1–6 and 11–15.
Figure 17:
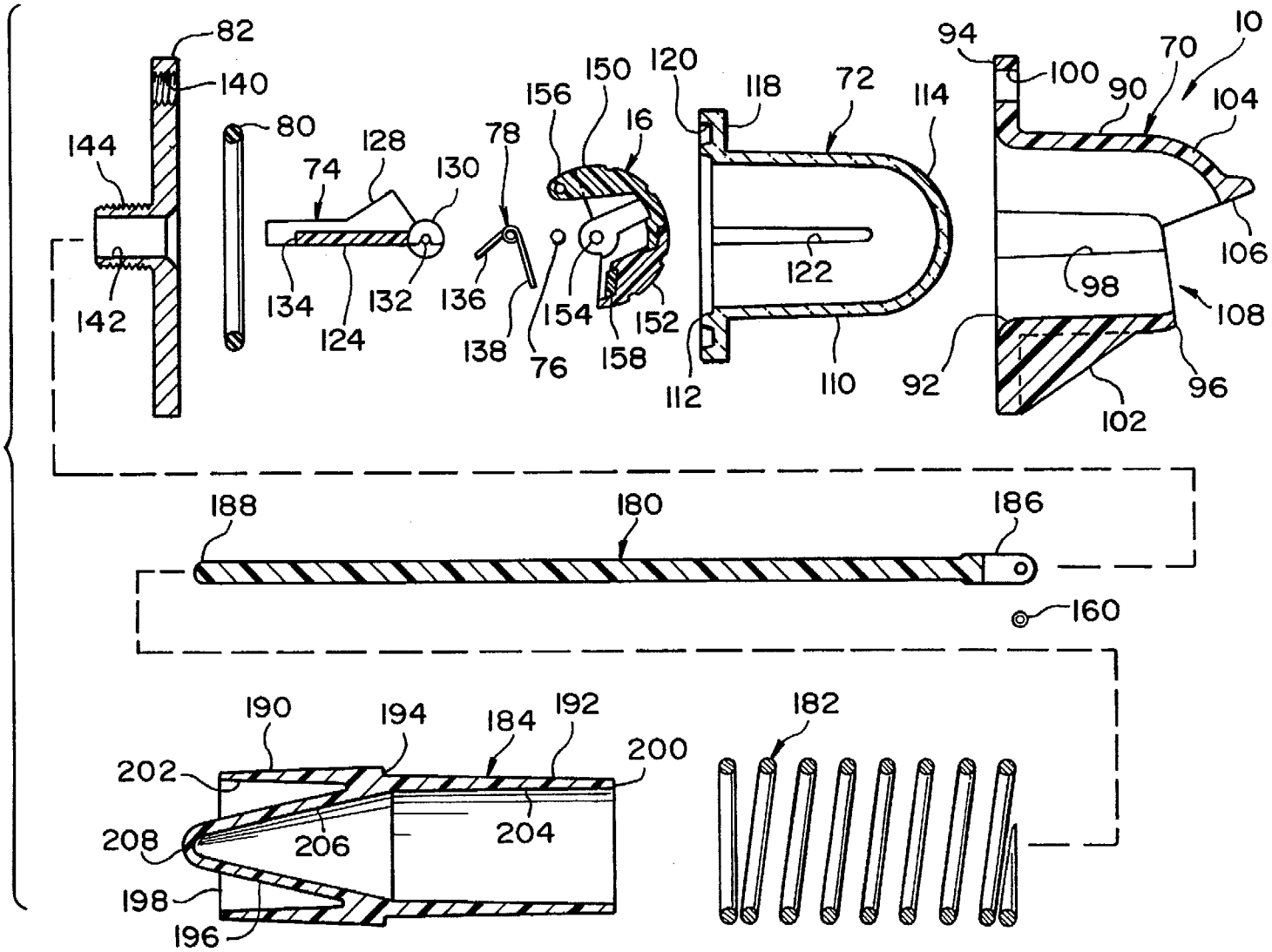
FIG. 17 is an exploded, side longitudinal cross-sectional view of the electrical contact position indicator assembly of FIGS. 1–6 and 11–16.
Figure 18:
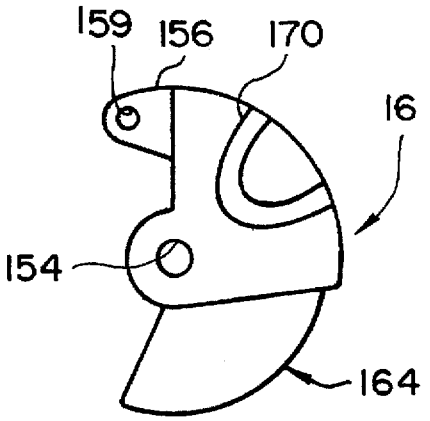
FIG. 18 is a side elevational view of the base portion of the indicator for the electrical contact position indicator assembly illustrated in FIGS. 1–6 and 11–17.
Figure 19:
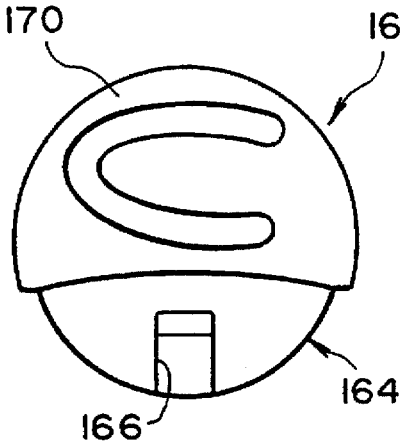
FIG. 19 is a front elevational view of the base portion of the indicator illustrated in FIG. 18.
Figure 20:
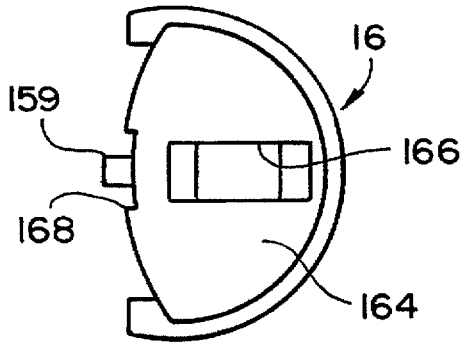
FIG. 20 is a rear elevational view of the base portion of the indicator illustrated in FIGS. 18 and 19.
Figure 21:
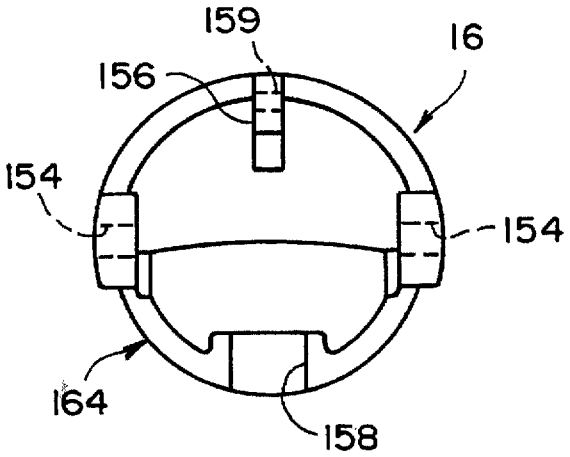
FIG. 21 is a bottom plan view of the base portion of the indicator illustrated in FIGS. 16–18.
Figure 22:
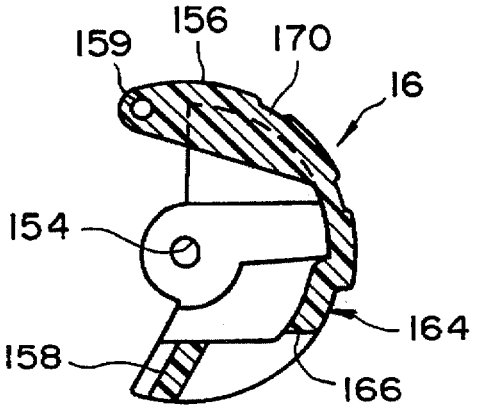
FIG. 22 is a vertical transverse cross-sectional view of the base portion of the indicator illustrated in FIGS. 18–21 taken along section line 22–22 of FIG. 17.
Figure 23:
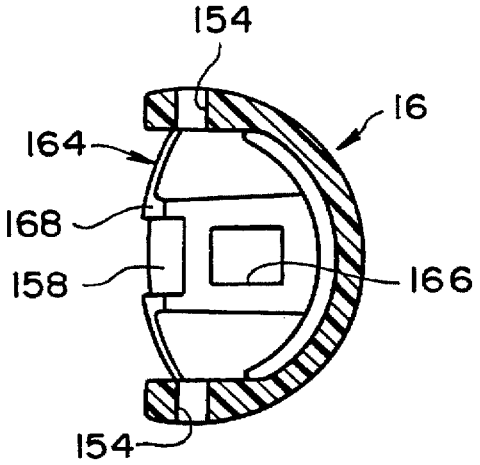
FIG. 23 is a horizontal transverse cross-sectional view of the base portion of the indicator illustrated in FIGS. 18–22 taken along section line 23–23 of FIG. 19.

As illustrated in FIGS. 7–9, interrupter 40 is preferably an arc-spinner interrupter of the type disclosed in U.S. Pat. No. 5,015,810 to Eppinger et al, which is hereby incorporated herein by reference. As seen in FIGS. 7–9, interrupter 40 basically includes a fixed electrical contact 42 connected to load bushing 38 via bus bar 44, a ring electrode 46 coupled to fixed contact 42 through a field coil (not shown) surrounding the ring electrode 46 and mounted in an insulated support structure 48, and a second electrical contact 50 connected to load bushing 36 through a bus bar 52.

Movable contact 50 is mounted on a movable arm 54, which moves along a path substantially perpendicular to the central longitudinal axis of the ring electrode 46 for selectively connecting movable contact 50 with the fixed contact 42. Movement of arm 54 is controlled by main latching assembly 60 for moving movable contact 50 between a first closed contact position in which movable contact 50 engages fixed contact 42 in current-carrying engagement and a second opened contact position in which movable contact 50 is separated from fixed contact 42, i.e., opened current-interrupting position.

As particularly seen in FIGS. 5 and 6, main latching assembly 60 has a main latching plate 62, which is pivotally supported for rotation about pivot shaft 64. Main latching plate 62 is connected to arm 54 of movable contact 50 via a slot 66. Accordingly, pivotal movement of main latching plate 62 causes movable contact 50 to be either engaged with fixed contact 42 or disengaged from fixed contact 42. Main latching plate 62 is basically moved to a contact closed position by a solenoid operated plunger 67, and is basically moved to a contact opened position by a tension spring 68. Since the details and operation of main latching assembly 60 are both discussed in detail in U.S. Pat. No. 5,103,364 to Kamp, which is incorporated herein by reference, main latching assembly 60 and its operation will not be further discussed or illustrated in detail herein.

Referring again to indicator assembly 10, indicator housing 14 is particularly illustrated in FIGS. 14–17, and includes an outer cover 70, an inner cover 72, a pivot plate 74, a pivot pin 76, a torsion spring 78, a gasket 80, a mounting plate 82, and three fasteners or screws 84. Indicator 16 is pivotally mounted within indicator housing 14 and protected from the environment by indicator housing 14.

Outer cover 70 is preferably an integrally formed, one-piece, unitary member constructed of a substantially hard, rigid plastic material such as a UV resistant polycarbonate, which is opaque to protect indicator 16 from direct sunlight. In particular, outer cover 70 is a tubular member with a tubular body portion 90 having a first substantially circular open end 92 with an annular mounting flange 94 extending radially outwardly therefrom, and a second partially open end 96 for viewing indicator 16.

Tubular body portion 90 of outer cover 70 has a pair of longitudinally extending positioning slots 98 for receiving a portion of inner cover 72 therein to ensure correct orientation between outer cover 70 and inner cover 72, when inner cover 72 is nested within outer cover 70. Positioning slots 98 are preferably spaced 180° apart about the circumference of body portion 90. Preferably, body portion 90 is substantially cylindrical with a substantially circular transverse cross-section.

Annular mounting flange 94 of outer cover 70 has three fastener openings 100 for receiving fasteners 84 therethrough to releasably couple mounting plate 82 to first end 92 of outer cover 70. A plurality of reinforcing ribs 102 extend between mounting flange 94 and the exterior surface of body portion 90 for reinforcing and strengthening outer cover 70.

Second end 96 of body portion 90 has a curved hood portion 104 with an arcuate visor 106 extending outwardly therefrom to form a viewing opening 108 for viewing indicator 16 therethrough. Curved hood portion 104 is spherically shaped and preferably extends about 71° from second end 96 towards the longitudinal axis to substantially cover the top half of second end 96 of body portion 90. Visor 106 extends outwardly from curved hood portion 104 to provide additional protection to indicator 16 from direct sunlight.

Opening 108 is substantially "eye" shaped and extends a full 180° between positioning slots 98 and extends approximately 90° between the bottom edge of body portion 90 and visor 106. Accordingly, opening 108 provides a large opening in which indicator 16 can be viewed from either of its sides as well as directly below or directly in front of indicator assembly 10

Inner cover 72 is also a substantially tubular member, which is preferably an integrally formed, one-piece, unitary member constructed of a substantially hard, rigid plastic material such as a UV resistant polycarbonate. However, unlike outer cover 70, inner cover 72 is optically clear or transparent so that indicator 16 can be seen therethrough. Basically, inner cover 72 includes a tubular body portion 110 with an open end 112 and a spherically closed end 114. Inner cover 72 is designed to slip into or nest within outer cover 70 such that they can be easily slipped together and interlocked. Specifically, body portion 110 of inner cover 72 has a pair of longitudinally extending protrusions 116 extending outwardly from the outer surface of inner cover 72. Protrusions 116 are designed to fit within positioning slots 98 of outer cover 70 for ensuring correct alignment therebetween and to prevent relative axial rotation therebetween. Protrusions 116 are, of course, positioned 180° apart to mate with positioning slots 98 of outer cover 70.

An annular flange 118 is formed adjacent open end 112 of inner cover 72 and extends radially outwardly therefrom. Annular flange 118 includes a recess 120 for receiving gasket 80 therein for sealing the interface between inner cover 72 and mounting plate 82. This provides a weatherproof seal to protect indicator 16 from the weather as well as sealing the indicator assembly 10 to tank 30 of recloser 12.

Body portion 110 of inner cover 72 has a pair of pivot slots 122 extending longitudinally along its inner surface for receiving pivot plate 74 and pivot pin 76 therein to fixedly retain pivot plate 74 within inner cover 72. Pivot slots 122 do not extend the full length of the inner surface of body portion 110 of inner cover 72, but rather only extends from open end 112 of body portion 110 to the point where closed end 114 begins to form its spherical end. Accordingly, this ensures that pivot plate 74 is non-movably retained within inner cover 72. Specifically, one end of pivot plate 74 will engage mounting plate 82, while its other end will engage the end of pivot slots 122 to limit longitudinal movement of pivot plate 74 within inner cover 72.

Pivot plate 74 is also preferably an integrally formed one-piece, unitary member constructed of a substantially hard, rigid plastic material such as a polycarbonate. Pivot plate 74 has a substantially flat rectangular section 124 with a pair of longitudinal side edges 126 which are received within pivot slots 122 of inner cover 72, a pair of stop members 128 extending perpendicularly from one side of section 124 for limiting pivotal movement of indicator 76, and a pair of pivot members 130 formed at one of the end edges of flat rectangular section 124. Each of the pivot members 130 includes a pivot hole 132 for receiving pivot pin 76 therein to pivotally retain indicator 16 within inner cover 72. The end edge of pivot plate 74 opposite pivot members 130 includes a rectangular cutout 134 for providing clearance for a part of operating mechanism 18 as discussed hereinafter.

Torsion spring 78 is a conventional torsion spring which is received over pivot pin 76 and positioned between pivot members 130 of pivot plate 74. Accordingly, torsion spring 78 is positioned along the longitudinal axis of indicator assembly 10. Torsion spring 78 is designed to bias indicator 16 to its second position which indicates an opened contact position. Specifically, torsion spring 78 is preloaded such that its first end 136 engages flat section 124 of pivot plate 74 between pivot members 130, and its second end 138 engages a portion of indicator 16 to bias indicator 16 to its second opened contact position.

Gasket 80 is a conventional O-ring seal made of a suitable elastomeric material or rubber such as Minnesota Rubber No. 4273 366Y. Gasket 80 seals indicator assembly 10 from the weather as well as seals the opening in the housing 30 of recloser 12 to contain the insulating gas or the like from escaping out of housing 30. In other words, indicator assembly 10 does not require any internal seals for sealing the interconnection between interrupter 40 and indicator assembly 10, and thus, the insulating gas of the recloser is contained within housing 30 and indicator assembly 10. Preferably, gasket 80 is a quad-X four lobed O-ring seal, which has a circular cross-section with four arms extending outwardly therefrom, with each annular arm being spaced approximately 90° apart. Since this is a conventional gasket, gasket 80 will not be discussed or illustrated herein.

Mounting plate 82 is preferably made of a lightweight, strong rigid material, which is rust resistant, such as aluminum. Mounting plate 82 preferably is a circular member with three threaded mounting holes 140 for threadedly receiving fasteners or screws 84 therein for securing outer and inner covers 70 and 72 thereto. Mounting holes 140 are preferably equally spaced apart, i.e., spaced 120° apart. Mounting plate 82 has a central hole 142 and a threaded shaft 144 extending axially therefrom and concentric with hole 142. Threaded shaft 144 is designed to be threadedly secured in fitting 148 which is rigidly secured within an opening or hole 149 in tank 30 of recloser 12. Hole 142 has a frustoconical beveled edge on the side of mounting plate 82 opposite shaft 140 to provide sufficient clearance for the portion of the operating mechanism 18 passing therethrough. Preferably, the annular ring-shaped sealing area of mounting plate 82 which engages gasket 80 is provided with a micro inch finish to ensure proper sealing therebetween.

Indicator 16 is a three-dimensional, spherical or curvilinear member, which extends approximately 200° along a vertical plane passing through the longitudinal axis of indicator assembly 10, and which extends approximately 180° along a horizontal plane passing through the longitudinal axis of indicator assembly 10. Approximately 100° of the sphere of indicator 16 is visible through opening 108 of outer cover 70 along the vertical plane of indicator 16, while approximately 180° of the sphere of indicator 16 is visible through opening 108 of outer cover 70 along the horizontal plane of indicator 16. Of course, indicator 16 can have an exterior surface formed of a plurality of flat surfaces to form a sphere, or can have a somewhat block shaped exterior surface. The important feature of any indicator in accordance with the present invention is that the position of the indicator, which is visible, should be substantially visible from in front, from below, and from both sides of the indicator, i.e, a wide variety of angles. Preferably, indicator 16 is an integrally formed member with two parts, i.e., a base portion 150 and a molded inlay portion 152 molded onto base portion 150.

Preferably, base portion 150 is molded from a hard, rigid plastic material such as a UV inhibited polycarbonate and has a first color. In other words, the polycarbonate of base portion 150 is colored. Since base portion 150 is used to indicate the closed position, the preferred color for base portion 150 is red.

As seen in FIGS. 18–23, base portion 150 is a partial spherical member, which is preferably greater than half of a sphere. Specifically, base portion 150 includes a pair of pivot holes 154 spaced apart 180° from each other along the horizontal axis of indicator assembly 10 such that holes 154 are aligned for receiving pivot pin 76 therein to pivotally mount indicator 16 to pivot plate 74 within inner cover 72 of housing 14.

Base portion 150 also includes a connecting flange 156 and a spring receiving recess 158. Connecting flange 156 extends outwardly from one edge of the sphere of indicator 16 and positioned along a vertical plane passing through the longitudinal axis of indictor assembly 10. In other words, connecting flange 156 is positioned midway between pivot holes 154. Connecting flange 156 is pivotally coupled to operating mechanism 18 to rotate indicator 16 about pivot pin 76 between its opened and closed positions. In particular, connecting flange 156 is provided with a hole 159 for receiving a rivet 160 therein to interconnect operating mechanism 18 to indicator 16. Recess 158 is positioned opposite connecting flange 156 and receives the second end 138 of torsion spring 78. Accordingly, indicator 16 is normally biased by torsion spring 78 to its opened contact position.

Preferably, the spherical surface of base portion 150 is provided with a recessed section 164 which extends over half of the spherical surface of base portion 150 for receiving inlay portion 152 thereon. In particular, recess section 164 includes an opening 166 extending through base portion 150 as well as a notched portion 168 formed by recess 158 for receiving a portion of the molded inlay portion 152 therein to secure molded inlay portion 152 to base portion 150. The other half of the spherical surface of base portion 150 includes recessed indicia 170, which is preferably in the form of the letter "C" to indicate the closed contact position. Indicia 170 is preferably colored or painted with a contrasting color from the color of base portion 150, such as white when base portion 150 is red.

Inlay portion 152 is also preferably formed of a substantially hard, rigid plastic material which is substantially identical to the material of the base portion 150. Accordingly, inlay portion 152 is preferably a UV inhibited polycarbonate. Since inlay portion 152 represents the opened contact position, inlay portion 152 should be of a different color from base portion 150. Preferably, inlay portion 152 is a green polycarbonate material. Of course, both base portion 150 and inlay 152 can be constructed of the same color and then modified with other indicia to distinguish the two portions of indicator 16.

Inlay portion 152 is molded onto recessed section 164 of base portion 150 to form a substantially smooth continuous spherical surface, except for the indicia formed thereon. Inlay portion 152 has recessed indicia 172 formed therein which is different from indicia 170. Preferably, indicia 172 is in the form of the letter "O" to indicate the opened contact position. Indicia 172 is recessed within inlay portion 152 and colored with a contrasting color from the remaining color of inlay portion 152. For example, inlay portion 152 is preferably molded from a green material or some other color, which contrasts with the color of base portion 150, while indicia 172 is colored or painted with a contrasting color such as white.

Referring now to operating mechanism 18 which includes an operating arm 180, a compression spring 182 and a sleeve 184. Operating mechanism 18 interconnects interrupter assembly 33 of recloser 12 to indicator 16 of indicator assembly 10 so that indicator 16 is responsive to the opening and closing of contacts 42 and 50 by interrupter 40. It will be apparent to those skilled in the art that the disclosed operating mechanism 18 can be replaced with an electronically controlled operating mechanism or other mechanically operating mechanisms depending on the electrical device or recloser being fitted with indicator assembly 10. One of the most important aspect of any operating mechanism is that it operates quickly, efficiently and reliably without interfering with the operation and timing of the interrupter assembly.

Operating arm 180 is designed to be pivotally coupled to connecting flange 156 of indicator 16 by rivet 160 and movably engaged with sleeve 184 for movement therewith. Specifically, operating arm 180 is provided with a clevis 186 at one end for straddling connecting flange 156 and for connecting operating arm 180 thereto by rivet 160 in a pivotal manner. The other end 188 of operating arm 180 is a smooth spherical end which movably engages sleeve 184 as described below for movement therewith in response to movement by main latching plate 62.

Operating arm 180 is constructed of a flexible, resilient material to allow for dimensional variations or tolerances in the operation of indicator assembly 10. Moreover, the flexibility of operating arm 180 allows it to act as a shock absorber to accommodate or absorb overtravel from the rapid operation. Preferably, operating arm 180 is formed as an integral, one-piece, unitary member constructed of a plastic material such as polycarbonate.

Compression spring 182 is a conventional compression spring which is preferably constructed out of a corrosion resistant metallic material such as stainless steel. Compression spring 182 has an inner diameter which is sized to be received over a portion of sleeve 184 as discussed below. Compression spring 182 is positioned within the solenoid of recloser 12 for biasing sleeve 184 against main latching plate 62. Thus, sleeve 184 is responsive to the movement of main latching plate 62 during opening and closing of the contacts 42 and 50.

Sleeve 184 has a first tubular section 190, a second tubular Section 192 extending from first tubular section 190, an annular abutment surface 194 formed between the first and second tubular sections 190 and 192, and a cone shaped section 196 formed along the inner surface of first tubular section 190. Preferably, sleeve 184 is formed as an integral, one-piece, unitary member constructed of a lightweight, rigid, corrosion resistant material such as a plastic. Preferably, sleeve 184 is constructed of polycarbonate.

Preferably, first tubular section 190 tapers slightly from abutment surface 194 to its free end 198, while second tubular section 192 tapers in the opposite direction from abutment surface 194 towards its free end 200. Free ends 198 and 200 are both open ends. However, the tip of cone-shaped section 196 extends out of open end 198 for engaging main latching plate 62. Tubular sections 190 and 192 each has a substantially cylindrical inner surface 202 and 204, respectively, which extends to its respective free end 198 or 200. Cone-shaped section 196 has a cone-shaped inner surface 206 which is substantially contiguous with inner surface 204 of second tubular section 192 for receiving end 188 of operating arm 180 therein.

Sleeve 184 is designed to be slidably received within plunger 67 of the interrupter assembly 33 so that sleeve 184 moves in response to the opening and closing of contacts 42 and 50 of interrupter 40. Specifically, end 208 of the cone-shaped section 196 of sleeve 184 engages main latching plate 62, while compression spring 182, which is positioned around second tubular portion 192, engages stop member 68 of interrupter assembly 33 and abutment surface 194 of sleeve 184. Thus, sleeve 184 is biased against main latching plate 62 by compression spring 184 to move back and forth as main latching plate 62 moves between the contact closed position and the contact opened position. This sliding or reciprocating movement of sleeve 184 in turn reciprocates operating arm 180, which in turn pivots indicator 16 between its first and second positions.

Installation and Operation of Indicator Assembly 10

Indicator assembly 10 can be assembled, for example, by first coupling operating arm 180 to indicator 16 by rivet 160. Next, indicator 16 can be coupled to pivot plate 74 by pivot pin 76 and torsion spring 78. Specifically, pivot pin 76 is passed through the pivot holes 154 of indicator 16 and through pivot holes 132 of pivot plate 74 such that torsion spring 78 is retained on pivot pin 76 between pivot members 130 with first end 136 of torsion spring 78 engaging pivot plate 74 and second end 138 of torsion spring 78 engaging recess 156 of indicator 16.

Now, indicator 16 together with pivot plate 74 and torsion spring 78 coupled thereto by pivot pin 76 are slid within inner cover 72. Indicator 16 is held in place within inner cover 72 since side edges 126 of pivot plate 74 are received within pivot slots 122 of inner cover 72. Then, outer cover 70 is slid over inner cover 72 such that the positioning protrusions 166 of inner cover 72 are slid within positioning slots 98 of outer cover 70 to prevent any relative axial rotation therebetween. Finally, gasket 80 is placed within recess 120 of inner cover 72 and mounting plate 82 is fastened to outer cover 70 via fasteners 84.

Indicator assembly 10 can now be retrofitted to an existing recloser or electrical device, or can be part of new reclosers or electrical devices. In either case, the only parts of indicator assembly 10 which must be installed internally of recloser 12 are sleeve 184 and compression spring 182. Specifically, sleeve 184 with compression spring 182 positioned thereon are installed within the solenoid of interrupter assembly 33 such that sleeve 184 is slidably received within plunger 67 of interrupter assembly 33 with compression spring 182 biasing sleeve 184 against main latching plate 62. In particular, end 208 of the cone-shaped section 196 of sleeve 184 engages main latching plate 62 to move sleeve 184 therewith against the force of spring compression 182. Accordingly, now recloser, or the electrical device, can now be closed.

Next, a hole 149 is formed in tank 30 for receiving fitting 148, which is preferably welded thereto. The fitting 148 is designed to threadedly receive threaded shaft 144 of mounting plate 82. Alternatively, tank 30 could be provided with three threaded studs welded thereto instead of fitting 148 to eliminate mounting plate 82 and fitting 148 with only slight modifications to indicator assembly 10. Installation of indicator assembly 10 to recloser 12 is then completed by merely inserting operating arm 180 through the hole 149 formed in tank 30 Such that end 188 of operating arm 180 engages the tip end of the interior surface of cone-shaped section 196 of sleeve 184, and threading shaft 144 of mounting plate 82 into fitting 148.

In operation, indicator assembly 10 is normally biased to indicate an opened contact position. Specifically, torsion spring 78 applies a rotational force on indicator 16 to bias indicator 16 about the axis of pivot pin 76, i.e., in a counterclockwise direction as shown in the figures, such that inlay portion 152 containing indicia 172 is visible through the window formed by the transparent end of inner cover 72 and the opening 108 in outer cover 70. In other words, inlay portion 152 of indicator 16 is normally aligned with opening 108 of outer cover 70 such that indicia 172 of inlay portion 152 is visible through the transparent inner cover 72 from a wide variety of angles. Also, compression spring 182 normally biases sleeve 182 against the main latching plate 62, i.e., downwardly as seen in FIG. 5, such that sleeve 184 is biased also to the opened contact position.

Once the electronic circuitry of recloser 12 activates the solenoid to close the contacts 42 and 50, the plunger 67 is moved upwardly as seen in FIGS. 5 and 6 by the solenoid so as to move main latching plate 62, which in turn, moves movable contact 50 into engagement with fixed contact 42. This movement of main latching plate 62 causes sleeve 184 to move upwardly as seen in FIG. 5 against the force of compression spring 182. Sleeve 184 in turn moves operating arm 180 to the right as seen in FIGS. 10–13 to pivot or rotate indicator 16 about the axis of pivot pin 76. This movement causes indicia 170 to now align with the window formed by transparent inner cover 72 and opening 108 of outer cover 70 so as to be visible in a wide variety of angles. Accordingly, indicator assembly 10 in this position indicates a closed contact position. Of course, should recloser 12 open the contacts, main latching plate 62 would move downwardly as seen in FIG. 6, and indicator assembly 10 would again be moved to the opened contact position due to the forces of torsion spring 78 and compression spring 182 acting on indicator 16 and sleeve 184, respectively.

While only one embodiment has been chose to illustrate the invention, it will be understood by those skilled in the art that various changes and modifications can be made herein without departing form the scope of the invention as defined in the appended claims.

What is claimed is:

1. A contact indicator assembly, comprising:

a housing adapted to be mounted to an electrical device;

a three-dimensional indicator movably mounted to said housing between a first position and a second position, said indicator including a first three-dimensional area with first indicia thereon being visible in said first position and concealed in said second position; and a second three-dimensional area with second indicia thereon being visible in said second position and concealed in said first position, said first and second areas being arranged when in said first and second positions, respectively, to be visible substantially from in front, from below and from both sides of said indicator; and an operating mechanism, adapted to be operatively coupled to the electrical device, for moving said indicator between said first and second positions in response to changes in flow of electrical energy through the electrical device, said operating mechanism including an operating arm comprising a rod coupled to said indicator at one end and movably coupled at its other end within the electrical device for longitudinal movement in response to closing and opening of electrical contacts of the electrical device, said rod being flexible and resilient to absorb shocks.

2. A contact indicator assembly according to claim 1, wherein said first and second areas are substantially spherical shaped areas with said first and second indicia formed thereon.

3. A contact indicator assembly according to claim 1, wherein each of said first and second indicia includes at least one symbol.

4. A contact indicator assembly according to claim 1, wherein said first indicia includes a first color, and said second indicia includes a second color which is different from said first color.

5. A contact indicator assembly according to claim 4, wherein each of said first and second indicia further includes at least one symbol.

6. A contact indicator assembly according to claim 1, wherein said indicator is pivotally mounted to said housing.

7. A contact indicator assembly according to claim 1, wherein said housing includes a first cover with an optically transparent section overlying said indicator such that said first and second indicia are selectively visible from the exterior of said housing.

8. A contact indicator assembly according to claim 1, wherein said housing further includes a second cover positioned adjacent said indicator to selectively conceal said first and second indicia.

9. A contact indicator assembly according to claim 8, wherein said first and second covers are separate members with said second cover overlying said first cover.

10. A contact indicator assembly according to claim 1, wherein said housing includes a mounting plate adapted to be coupled to an exterior portion of the electrical device.

11. An electrical device for receiving a flow of electrical energy, comprising:

a device housing;

a switch mechanism with a pair of electrical contacts being coupled to said device housing for closing and opening said contacts to control the flow of electrical energy within said device housing; and a contact indicator assembly for indicating status of electrical energy flow through said device housing, said contact indicator assembly including an indicator housing coupled to said device housing, a three-dimensional indicator movably mounted to said indicator housing between a first position and a second position, said indicator including a first three-dimensional area with first indicia thereon being visible externally of said indicator housing in said first position and concealed in said second position, and a second three-dimensional area with second indicia thereon being visible externally of said indicator housing in said second position and concealed in said first position, said first and second areas being arranged when in said first and second positions, respectively, to be visible substantially from in front, from below and from both sides of said indicator, and an operating mechanism operatively coupled between said switch mechanism and said indicator for moving said indicator between said first and second positions in response to closing and opening of said contacts by said switch mechanism, said operating mechanism including an operating arm comprising .a rod coupled to said indicator at one end and movably coupled at its other end within said device housing for longitudinal movement in response to closing and opening of electrical contacts of said switch mechanism, said rod being flexible and resilient to absorb shocks.

12. An electrical device according to claim 11, wherein said first and second areas are substantially spherical surfaces with said first and second indicia formed thereon.

13. An electrical device according to claim 11, wherein each of said first and second indicia includes at least one symbol.

14. An electrical device according to claim 11, wherein said first indicia includes a first color, and said second indicia includes a second color which is different from said first color.

15. An electrical device according to claim 14, wherein each of said first and second indicia further includes at least one symbol.

16. An electrical device according to claim 11 wherein said indicator is pivotally mounted to said indicator housing.

17. An electrical device according to claim 11, wherein said indicator housing includes a first cover with an optically transparent section overlying said indicator such that said first and second indicia are selectively visible from the exterior of said indicator housing.

18. An electrical device according to claim 17, wherein said indicator housing further includes a second cover positioned adjacent said indicator to selectively conceal said first and second indicia.

19. An electrical device according to claim 18, wherein said first and second covers are separate members with said second cover overlying said first cover.

20. An electrical device according to claim 11, wherein said indicator housing includes a mounting plate adapted to be coupled to an exterior portion of said device housing.

* * * * *